United States Patent [19]

Kanbe

[11] Patent Number: 4,534,712

[45] Date of Patent: Aug. 13, 1985

[54] LIQUID METAL MECHANICAL PUMP EQUIPPED WITH EMERGENCY SYPHON

[75] Inventor: Mitsuru Kanbe, Yokohama, Japan

[73] Assignee: Doryokuro Kakunenryo Kaihatsu Jigyodan, Tokyo, Japan

[21] Appl. No.: 479,078

[22] Filed: Mar. 25, 1983

[30] Foreign Application Priority Data

Mar. 30, 1982 [JP] Japan ..... 57-45068[U]

[51] Int. Cl.[3] ..... F04B 39/06; F01D 25/16

[52] U.S. Cl. ..... 417/366; 417/373; 417/424; 415/175; 376/203

[58] Field of Search ..... 417/368, 366, 373, 424, 417/902; 415/111, 112, 175; 376/203, 205, 206; 137/132

[56] References Cited

U.S. PATENT DOCUMENTS 3,276,508 10/1966 Stierlin ..... 137/132

3,951,738 4/1976 George et al. ..... 376/203

FOREIGN PATENT DOCUMENTS 0176390 10/1982 Japan ..... 415/175

*Primary Examiner*—Richard E. Gluck
*Assistant Examiner*—Peter M. Cuomo
*Attorney, Agent, or Firm*—Wenderoth, Lind & Ponack

[57] ABSTRACT

A liquid metal mechanical pump having therein a liquid metal free surface and a cover gas space over the liquid metal free surface and which is equipped with an emergency syphon system. This system has a syphon pipe and a liquid metal dump tank disposed outside the pump. The syphon pipe connects the pump and the dump tank so that the liquid metal in the tank flows out into the dump tank when the free surface of the liquid metal in the pump rises to a predetermined level higher than that of the normal operation of the pump.

3 Claims, 5 Drawing Figures

FIG. IB
PRIOR ART
Level
0
Elapsed time after gas line failure
20
21
22
23
24
25
FIG. IA
PRIOR ART
1
2
3
4
5
6
7
8
9
10
11
12
13
14
15

LIQUID METAL MECHANICAL PUMP EQUIPPED WITH EMERGENCY SYPHON

BACKGROUND OF THE INVENTION

This invention relates to a vertical free surface type pump and more particularly, to a liquid metal mechanical pump equipped with an emergency syphon system for preventing the liquid metal free surface inside the pump from rising to an upper mechanical bearing of the pump at the time of failure of a cover gas line.

A vertical, free surface type mechanical pump having a construction which has the free surface of the liquid metal inside a pump casing and in which a cover gas space is disposed over the free surface of the liquid metal is the type of pump most usually used as a primary circulating pump for a loop type liquid metal cooled fast breeder reactor. An example of such a mechanical pump is illustrated in FIG. 1A. Liquid sodium flows into a sustantially cylindrical casing 1 from a suction nozzle 2 at the lower end of the casing 1, is given a delivery pressure by an impeller 3 and flows out through a delivery nozzle 4. A pump drive shaft 7 for transmitting the rotating force to the impeller 3 is pivotally supported by a lower hydrostatic bearing 8 and an upper mechanical bearing 9 defining an overflow space between them. The liquid metal that enters the overflow chamber overflows to an overflow column 6 through an overflow pipe 5 is returned to the suction nozzle 2. A mechanical seal 10 for preventing the leakage of a cover gas (i.e. an inert gas) from the casing 1 is disposed below the mechanical bearing 9. The inert gas is caused to constantly flow downwards from the mechanical seal 10 in order to prevent the vapor of the liquid metal from rising into the seal and, at the same time, to apply a predetermined cover gas pressure, thereby setting the level of the free surface inside the pump and providing a required suction head necessary for the pump.

In the example of the prior art pump shown in FIG. 1A, the cover gas is supplied from a gas feed pipe 11 connected to the lower portion of the mechanical seal 10, descends through the gap between a shield 12 and the shaft 7, then enters a cover gas space 13 and is recovered through a gas discharge pipe 14 connected to the overflow column 6 and through an exhaust pipe 15. Thus, the cover gas circulation is effected. This cover gas pressure is higher than the atmospheric pressure of the atmosphere in which the pump is disposed. Accordingly, if the cover gas line or piping for the above-described cover gas circulation is accidentally broken, the free surface inside the pump drastically rises and, at times, it reaches the mechanical seal 10 as well as the mechanical bearing 9, thus causing serious damage to the pump and inviting leakage of the liquid metal.

The free surface inside the pump and the free surface inside the overflow column 6 shown in FIG. 1A are considered to be those when the pump is in the normal operation. FIG. 1B shows the changes in the free surfaces inside the pump and inside the overflow column when the pump is used as a primary circulating pump of a primary cooling system of a liquid metal cooled fast breeder reactor and the gas feed pipe 11 or the exhaust pipe 15 is broken. The ordinate in FIG. 1B corresponds to the height in FIG. 1A and the abscissa represents the elapsed time after the gas line failure. The curves in FIG. 1B have the following meanings. Reference numeral 20 designates the curve representing the pump free surface; reference numeral 21 designates the curve representing the overflow column free surface; reference numeral 22 designates a curve representing a cover gas pressure in a reactor vessel (represented by the head of the liquid metal); reference numeral 23 designates the upper end position of the gas line 14; reference numeral 24 designates the lower surface position of the shield plug 12; and reference numeral 25 designates the position of the gas feed pipe 11.

In this case, since the cover gas line of the pump is communicated with a cover gas system of a reactor vessel 30 as shown in FIG. 2, the gas pressure inside the pump drops down to the atmospheric pressure within a short period of time if the gas line is broken in the proximity of the pump. On the other hand, it is known that since the capacity of the gas space 31 in the reactor vessel 30 is far greater than that of the pump, it takes more than one minute before the cover gas pressure on the side of the reactor vessel drops down to the atmospheric pressure. In the interim, unbalance of the gas pressure develops between the reactor vessel and the pump and this pressure difference raises the free surface inside the pump. In other words, the free surface inside the overflow column 6 rises simultaneously with the failure of the gas line and, when it reaches the same level as the free surface inside the pump, both rise together. However, when the surface reaches the upper side of the gas line 14, the free surface inside the overflow column 6 can not rise very much any longer and only the free surface inside the pump continues rising. At this point, the cover gas pressure in the reactor vessel 30 still has a high pressure so that the free surface inside the pump reaches the shield plug 12, the mechanical seal 10 and the mechanical bearing 9, thereby not only causing serious damage to the pump but also inviting leakage of the liquid metal outside the pump. This danger becomes greater in the case of the cold leg pump arrangement because a cover gas pressure during operation is higher than that of a hot leg pump arrangement.

In FIG. 2, reference numeral 32 designates an outlet nozzle; reference numeral 33 designates a main cooling piping; reference numeral 34 designates a drain valve; reference numeral 35 designates a drain tank; and reference numeral 36 designates a cover gas refiner.

SUMMARY OF THE INVENTION

An object of the present invention is therefore to provide a mechanical pump for liquid metal which eliminates the drawbacks of prior art mechanical pumps, can prevent the free surface inside the pump from rising and reaching an upper mechanical bearing of the pump even if the failure of a cover gas line of the pump occurs, and hence can prevent the upper mechanical bearing and mechanical seal from being damaged by the rise of the liquid metal in the pump and thus prevent the liquid metal in the pump from leaking from the mechanical seal and injuring a person and associated.

To accomplish these objects, according to the present invention, an emergency syphon system is incorporated in a conventional liquid metal mechanical pump including a pump casing having therein a free surface of liquid metal and a cover gas space over the liquid metal free surface, a pump drive shaft extending through the pump casing and rotatably supported by a lower hydrostatic bearing and an upper mechanical bearing, a shield plug disposed below the upper mechanical bearing, and an overflow pipe fitted to the pump casing at a portion between the lower hydrostatic bearing and the upper mechanical bearing.

The emergency syphon system comprises a syphon pipe and a liquid metal dump tank disposed outside the pump casing. The syphon pipe connects the pump casing to the dump tank. The liquid metal in the pump casing flows out into the dump tank when the free surface of the liquid metal inside the pump casing rises to a predetermined level higher than that of the normal operation of the pump.

Other and further objects of the present invention will become more apparent from the following description and the accompanying drawings in which like reference numerals refer to like constituents.

DETAILED DESCRIPTION OF THE PREFERRED EMBODIMENTS

Figure 1:
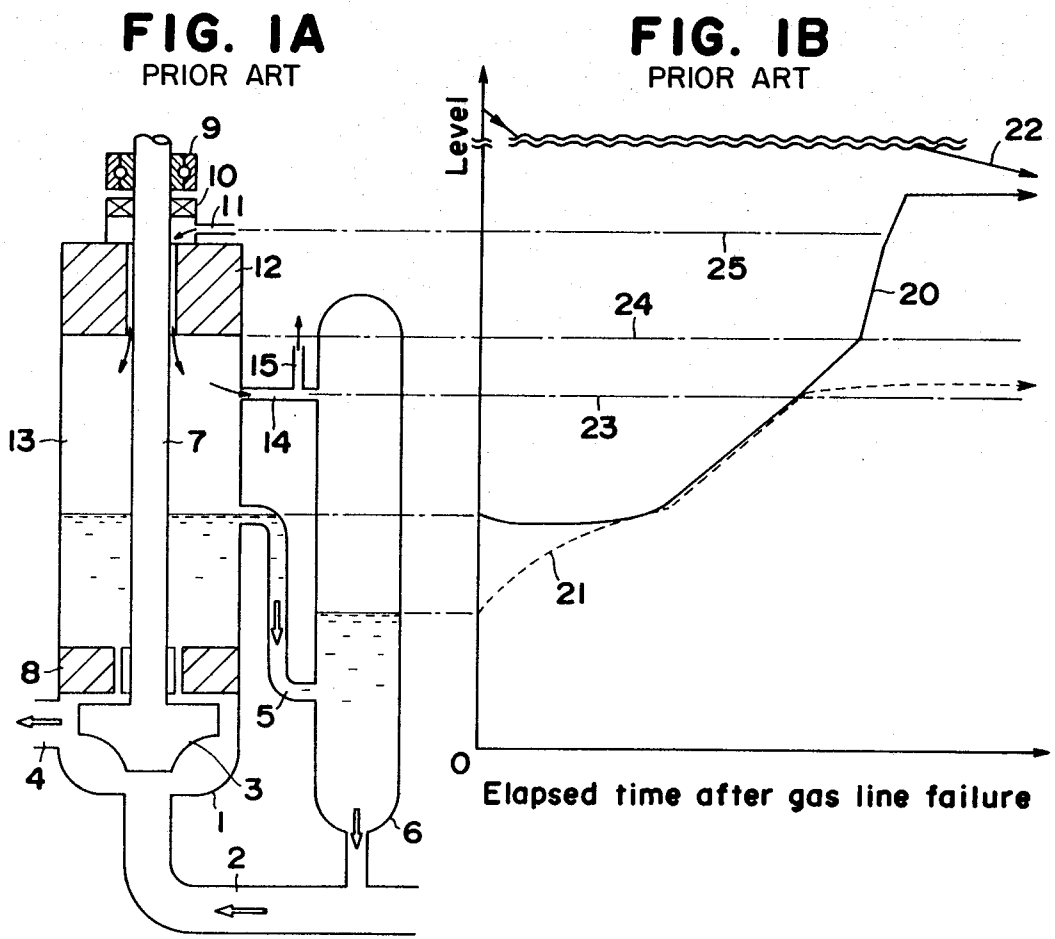
FIGS. 1A and 1B show an example of a conventional mechanical pump and the change in the free surfaces of liquid metal at the time of the cover gas line failure.
Figure 2:
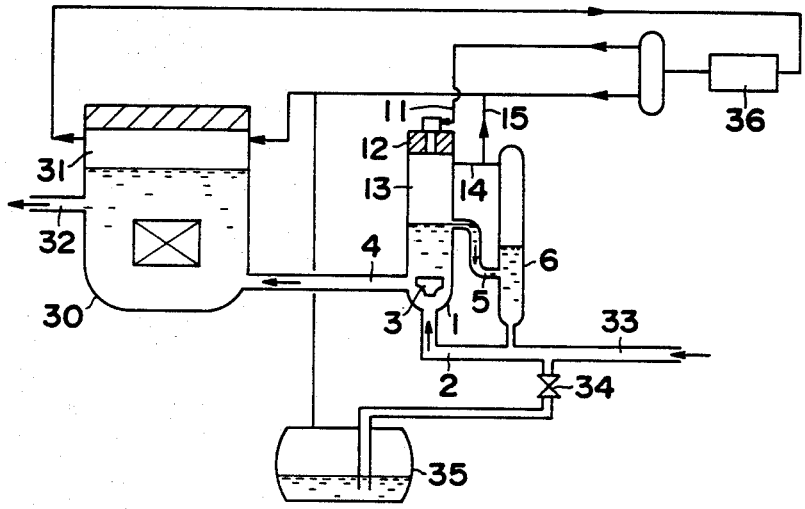
FIG. 2 PRIOR ART
FIG. 2 is a schematic view of an example of a conventional cover gas system.
Figure 3:
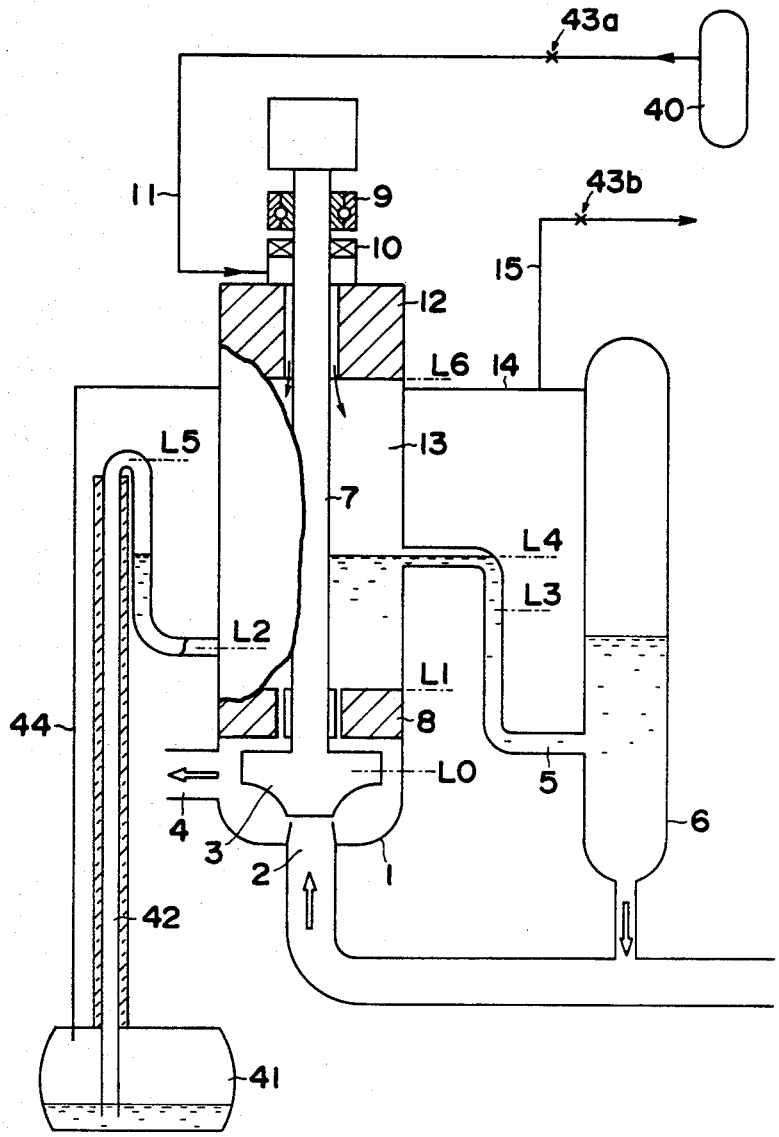
FIG. 3 is a schematic view showing one embodiment of a mechanical pump of the present invention in a cover gas system.

Referring now to FIG. 3, there is illustrated a mechanical pump according to one embodiment of the present invention in a cover gas system. Since the fundamental construction of this pump is the same as that of the prior art shown in FIG. 1A, like reference numerals are used to identify like components as in FIG. 1 and their explanation is omitted. The great difference of the pump according to the present invention from the prior art is that the pump casing 1 and a dump tank 41 disposed outside the pump casing are interconnected to each other by an emergency syphon pipe 42. This syphon pipe 42 is covered with a heat insulating material so that it is always kept at a temperature exceeding the solidifying point of the liquid metal. A gas pipe or line 44 is connected to the dump tank 41 for communicating the cover gas inside the dump tank with that in the pump.

The levels shown in FIG. 3 are as follows:

L0 . . . impeller center level;

L1 . . . minimum liquid level at which hydrostatic bearing is not exposed;

L2 . . . level at which emergency syphon pipe is connected to pump;

L3 . . . minimum liquid level inside pump during pump operation;

L4 . . . overflow level inside pump;

L5 . . . level at which emergency syphon operates;

L6 . . . shield plug lower surface level.

The liquid levels inside the pump casing 1 and inside an overflow column 6 shown in FIG. 3 are those when the pump is operating under the normal operating condition without gas line failure.

The cover gas is supplied from a gas header 40 through a gas feed pipe 11 fitted to the lower part of the mechanical seal 10 in the same way as in the prior art, then descends through the gap between the shield plug 12 and the drive shaft 7, enters the cover gas space 13 and is recovered through a gas discharge pipe 14 connected to the overflow column 6 and through an exhaust pipe 15. Thus, the cover gas circulation is effected.

In FIG. 3, if the gas line 11 or 15 is accidentally broken at the position 43*a* or 43*b* and the free surface inside the pump reaches the level L5, the emergency syphon 42 starts operation and the liquid metal inside the pump is discharged into the dump tank 41 through the syphon pipe 42. This syphon function continues until the free surface inside the pump drops down to the level L2. This emergency syphon system can be operated again by simply returning the liquid metal discharged into the dump tank 41 into the liquid metal circulation loop in which the pump is disposed. In order for the emergency syphon system to normally operate, it must start operating before the free surface inside the pump reaches the lower surface level L6 of the shield plug 12. This condition can be expressed by the following formula:

$$L4 < L5 < L6$$

The mechanical pump of the present invention provides an advantageous effect when disposed at a position where a particularly high availability factor is required, because the pump can be rapidly restored even if failure occurs in the cover gas line. In the case of a mechanical pump for a secondary cooling system of a fast breeder reactor, for example, it is not very necessary to consider the possibility that the atmospheric gas (air) will mix into the cover gas and oxidize the liquid metal at the time of failure of the gas line because the cover gas pressure in such a pump is high (1 $kg/cm^2G$ or more). In this case, since the cover gas is not made radioactive, it does not cause any harm even when it leaks outside the gas line.

In the case of a mechanical pump for a primary cooling system of a fast breeder reactor, the cover gas pressure is not very high (approximately 0.5 $kg/cm^2G$). In this case, since the atmospheric gas in nitrogen, it does not oxidize the liquid metal even if it mixes in the cover gas. The pump of the present invention is particularly suitable for use where the availability factor must be increased. If the contamination of the atmospheric gas due to the leakage of the cover gas becomes a problem, a shut-off system for the cover gas line may be employed conjointly.

Figure 4:
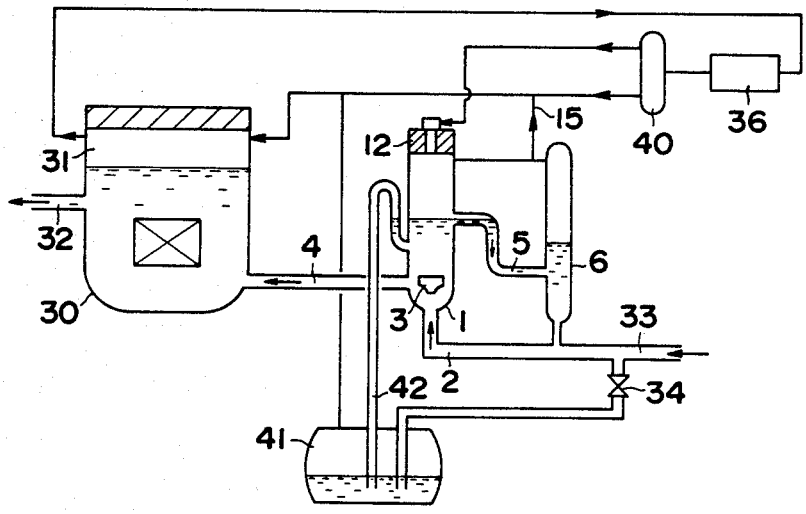
FIG. 4 is a schematic view showing an example of the use of the mechanical pump of the present invention.

FIG. 4 illustrates an example in which the mechanical pump of the present invention is used as a primary circulating pump for the primary cooling system of a liquid metal cooled fast breeder reactor.

In the present invention, the emergency syphon pipe 42 is especially referred to as the "syphon" for the following reason. If a mere overflow pipe is connected at the level L5, the free surface inside the pump is held at this level L5 when it rises. However, the shield plug 12 of the pump is designed so as to have a predetermined heat shielding function at the ordinary level L4. If the free surface is held at such an abnormally high level as described above, it becomes impossible to hold the temperature at the mechanical seal 10 and the seal at the joint portion between the shield plug 12 and the casing 1, which is not shown in FIG. 3, below predetermined values and this is very dangerous. In the case of failure of the gas line which is assumed in the present invention, the free surface inside the pump drastically rises and after it reaches the level L5, it rapidly drops due to the operation of the emergency syphon system of the present invention. Accordingly, since the time in which the free surface reaches the level L5 is only a short period of time, there is no problem in the pump of the present invention. Strictly speaking, the position L2 of the emergency syphon pipe 42 is defined by the following relation:

$$L1 \leqq L2 \leqq L4$$

If L2 is higher than L4, it is dangerous for the reason described above. The level L2 may be at an arbitrary position so long as it is between L1 and L4. When the failure which is assumed in the present invention develops, the operation can not be restarted unless repair is complete. For this reason, the level after the operation of the emergency syphon may be lower than the ordinary level range, i.e. L3 to L4.

Having the construction described above, the mechanical pump according to the present invention prevents the free surface inside the pump from rising up to the upper mechanical seal of the pump at the time of the gas line failure and hence, can prevent damage of the mechanical seal and the mechanical bearing and the leakage of the liquid metal outside the pump.

While the described embodiments represent the preferred form of the present invention, it is to be understood that changes and modifications will occur to those skilled in the art without departing from the scope of the appended claims.

What is claimed is:

1. A mechanical pump means for liquid metal, comprising:

a pump casing having a lower hydrostatic bearing near the lower end thereof, an upper mechanical bearing at the upper end thereof, and a shield plug between said mechanical bearing and said casing and sealing the upper end of said casing and having the lower surface thereof exposed in said casing and defining with said hydrostatic bearing an overflow chamber in said casing, said overflow chamber normally having a liquid metal therein with a free surface and the remainder of said overflow chamber above said free surface being a cover gas space;

a drive shaft extending through said pump casing and rotatably supported in said bearings;

an overflow pipe connected to said pump casing at a level between the lower hydrostatic bearing and the upper mechanical bearing;

an emergency syphon system comprising a syphon pipe and a liquid metal dump tank disposed outside said pump casing, said syphon pipe having a shorter leg opening into said pump casing at a level between said lower hydrostatic bearing and the lever of said overflow pipe and having a longer leg emptying into said dump tank and having the top of the syphon pipe at a level between the level of said overflow pipe and said lower surface of said shielding plug.

2. The mechanical pump according to claim 1 wherein said syphon pipe comprises means for keeping said syphon pipe at a temperature higher than the solidifying temperature of the liquid metal.

3. The mechanical pump according to claim 1 further comprising a gas line connecting the space in the upper part of said dump tank and said cover gas space inside said pump casing.

* * * * *